US011160343B2

(12) United States Patent
Burger

(10) Patent No.: US 11,160,343 B2
(45) Date of Patent: Nov. 2, 2021

(54) PROTECTIVE CASE

(71) Applicant: Mason Burger, Athens, WI (US)

(72) Inventor: Mason Burger, Athens, WI (US)

( * ) Notice: Subject to any disclaimer, the term of this patent is extended or adjusted under 35 U.S.C. 154(b) by 85 days.

(21) Appl. No.: 16/688,686

(22) Filed: Nov. 19, 2019

(65) Prior Publication Data

US 2020/0154841 A1 May 21, 2020

Related U.S. Application Data

(60) Provisional application No. 62/770,286, filed on Nov. 21, 2018.

(51) Int. Cl.

| | |
|---|---|
| ***A45C 11/24*** | (2006.01) |
| ***B65D 43/16*** | (2006.01) |
| ***A45C 13/00*** | (2006.01) |
| ***B65D 43/22*** | (2006.01) |

(52) U.S. Cl.

CPC ..... *A45C 11/24* (2013.01); *A45C 13/005* (2013.01); *B65D 43/162* (2013.01); *B65D 43/22* (2013.01); *B65D 2203/02* (2013.01)

(58) Field of Classification Search

CPC ..... A45C 11/24; A45C 13/00; A45C 13/005; B65D 43/162; B65D 43/22; B65D 5/5206

USPC ..... 220/263, 834, 839, 260, 833, 835; 206/1.5

See application file for complete search history.

(56) References Cited

U.S. PATENT DOCUMENTS

| | | | | |
|---|---|---|---|---|
| 4,005,798 | A | 2/1977 | Minsky | |
| 4,208,117 | A | 6/1980 | Harvey et al. | |
| 4,750,611 | A | 6/1988 | Morrone | |
| 4,753,351 | A | 6/1988 | Guillin | |
| 6,220,442 | B1 * | 4/2001 | Merrell | B65D 43/162 206/521 |
| 10,358,255 | B2 | 7/2019 | Giannopoulos et al. | |
| 2014/0138384 | A1 * | 5/2014 | O'Brien | A45C 13/001 220/378 |
| 2014/0183067 | A1 * | 7/2014 | Carnevali | A45C 11/00 206/37 |
| 2014/0262867 | A1 | 9/2014 | Weinberg | |
| 2015/0084326 | A1 * | 3/2015 | Petkovsek | B42D 15/006 283/81 |
| 2015/0265019 | A1 | 9/2015 | Niedzwiecki et al. | |

FOREIGN PATENT DOCUMENTS

| | | | | |
|---|---|---|---|---|
| WO | WO-0078638 | A1 * | 12/2000 | B65D 43/162 |

* cited by examiner

*Primary Examiner* — King M Chu
(74) *Attorney, Agent, or Firm* — Brandon Carlin

(57) ABSTRACT

A device for the storage of emergency information or items provided in a water-resistant protective case wherein the case is easily transportable or may be molded or formed into a larger structural component, the protective case including a base and a top hinged to said base to provide water-resistant sealing allowed in an open or closed position. The case base and top having side walls to create a volume within the case to provide storage within the case for items or emergency information.

20 Claims, 5 Drawing Sheets

PROTECTIVE CASE

CROSS REFERENCE TO RELATED APPLICATION

This application claims the benefit of U.S. Provisional Application 62/770,286, filed Nov. 21, 2018.

FIELD

The present disclosure is directed to the field of protective cases, and more particularly to protective cases for identifying and/or transmitting information, or the storage of seatbelt cutters, window breaking devices or any other small items which may prove useful in an emergency situation.

INTRODUCTION

People in high stress situations typically act in what is known as the fight-flight-freeze response. As hormones are released, these people acting under severe stress typically do not think clearly and may also struggle with their dexterity. Despite having access to a wealth of information at their fingertips in the form of a mobile cellular phone, the seemingly simplistic repetitive finger motions and taps required may prove difficult. Some persons may even fumble with a phone or their wallet and be unable to retrieve information or items when it is most needed. The affected person while acting in the fight-flight-freeze response may not even be able to recall, and thus retrieve, an item or information that is readily nearby.

It is known that having a set routine can help a person function almost without thought, which will increase the ability of knowing where an item is when needed such as when a person consistently places their wallet in a certain pocket, and thus can instinctively grab for their wallet when retrieval is necessary. However, when the item is moved to a different location the process of locating said item in an emergency can add additional stress. Further, in the event of a major catastrophe such as a car crash, items are typically jostled from their current position, which can create the above-mentioned precarious situation and results in an even more difficult search for the item.

Unfortunately, the result of these limitations is that persons are thus required to try and balance where their needed information is, as well as create a special place for emergency items as a seatbelt cutter, or a window breaking device. In the event of a major car accident and possible jostling, where a person needs to egress from a vehicle quickly, the person must be able to rapidly locate this needed emergency device, and can only hope that said device is in the last-known location, despite the accident.

Further, when emergency personnel need to locate information to quickly transmit this to needed persons, the emergency personnel are at the whim of the cognitive capacity of the impacted individual, or in their ability to locate and operate an electronic device if the information should be stored in said device and the device is still operational.

What is needed, therefore, is a protective device which can increase the consistency of a known location for items or information, while providing protection from potential water, fire, and/or physical impact.

BRIEF SUMMARY

The present invention is directed to a protective case for the rapid identification and recovery of personally identifiable information and/or for items which may be needed in an emergency situation.

Some examples of information are emergency contact information for the driver of a vehicle, contact information in regard to the nearest support center, specific procedures to be used in the event of an emergency, a QR code, instructions to be used in a particular situation, and other contact information, procedures, or instructions. These examples merely create a sample listing of some types of information which could be used with the protective case and are not a complete list, nor is this list intended to be used as limiting in any capacity. Those with skill in the art will understand and comprehend the plethora of information which could be stored within the protective case as disclosed herein.

Examples of items which could additionally or alternatively be contained within the protective case are a window breaking tool, a seatbelt cutter, a whistle, a key, a laser, an alarm, or mace. These examples are also intended to merely create a sample listing of some types of items which could be used with the protective case and are not a complete list, nor is this list intended to be used as limiting in any capacity. Those with skill in the art will understand and comprehend the plethora of items which could be stored within the protective case as disclosed herein.

The case is simple and inexpensive in its construction, while also being robust, rugged, and substantially surrounding any intended items or information. The items or information are separate from the case, and are thus insertable in, and removable from, the case or the case volume itself. The case is presently thought to be generally rectangular-shaped, though any similar shape such as a square, parallelogram, rhombus, or even an oval shape is contemplated herein. Additionally, it is contemplated that the protective case itself may be mobile such that it can be attachable in a variety of locations.

However, the protective case alternatively can be formed or generally molded into a vehicle's dashboard cover. In similar fashion, the protective case may be attached, formed or otherwise molded, welded, or created into a wall, cubicle, mailbox, baby stroller, or other item.

The protective case includes a case base and a case top, otherwise known herein as case shells, wherein the case top is secured to the case base by a hinge. The case base contains a plurality of side walls, a front wall, a back wall and a case base deck. Similarly, the alternative case shell, otherwise known as the case top, contains a plurality of side walls, a front wall, a back wall, and a case top deck. The case base and case top are connected by way of a hinge or spring, attached or formed on the back wall of the case top and attached or formed on the back wall of the case base. The case base and case top thus when attached form an inner volume.

It is thought presently that preferably the interior of the case shells contain raised protrusions within the volume of the shells of the case to keep a card, such as a business card, upright and within the case should the case be opened while in an upright position. To achieve this objective, the case may further contain a keeper projection, which is a term used herein to mean a protrusion, or bump, on the distal end of the volume of the shells of the case at a distance away from the raised protrusions. To provide stability for larger objects, an alternative stability device, such as vertical posts may be provided. These vertical posts, which may be made of a rigid material, or the same material as the protective case, can act as a stability device for the items or information contained within the protective case whether the protective case is in a longitudinal or a latitudinal position.

The case shells, being described herein as the combination of the case base and the case top, connect to form an inner volume within the shells. The case shells are portions which attach by way of a ridge wall located on one case shell which may be received by an inner channel located on or in the other case shell. In such a way the case shells form a singular case when removably attached, such that the case is a generally water-resistant protective device. To enhance the protective case's potential water-protection, a gasket may additionally be provided in the inner channel or on the ridge wall. A gasket is thought of herein as a mechanical seal which can optimize the mating of the shells of the protective case, and enhance the sealing capabilities of these shells.

To further increase the effectiveness of the removable attachment of the case shells, a thumb press releasable latch is provided, whereupon the thumb press releasable latch of one of the case shells is so dimensioned such as to receive and compress with a shoulder tab on the other case shell. This releasable latch may be pressed down, which in so doing disengages the compression between an opening provided in the releasable latch and the shoulder tab, and thus opening the case shells at said point, exposing the volume of the shells.

The exterior of the shells may be dimensioned in any matter as the situation or user sees fit, but it is contemplated that the exterior of the case top shell contains case top concave depressions, or external projections, such that the concave depressions or the interior of the case top external projections may receive a reflective label so as to visually illuminate the case. These concave depressions may form a logo, a pattern, words in any language, or a symbol. The exterior of the case base may also consist of concave depressions, such that adhesive tape, hook and loop fasteners, or magnets may be added to assist in affixing the protective case on a surface.

Preferably, the case shells' material is made from a heat-resistant material such as a high-density polymer. Some examples are polyethylene, a polypropylene, acrylonitrile butadiene styrene, a polyphenylene, any thermoset plastic, polyvinyl chloride, or polyamide, to name a few possibilities, though any generally heat-resistant polymer would suffice. In such a construction, the protective case thus is generally heat-resistant as described above, as well as a water-resistant case.

These and various other features, advantages, modes, and objects of the present invention will be made apparent from the following detailed description and any appended drawings.

DRAWINGS DESCRIPTION

One or more preferred exemplary embodiments of the present disclosure are illustrated in the accompanying drawings in which like reference numerals represent like parts throughout and in which.

Figure 4:
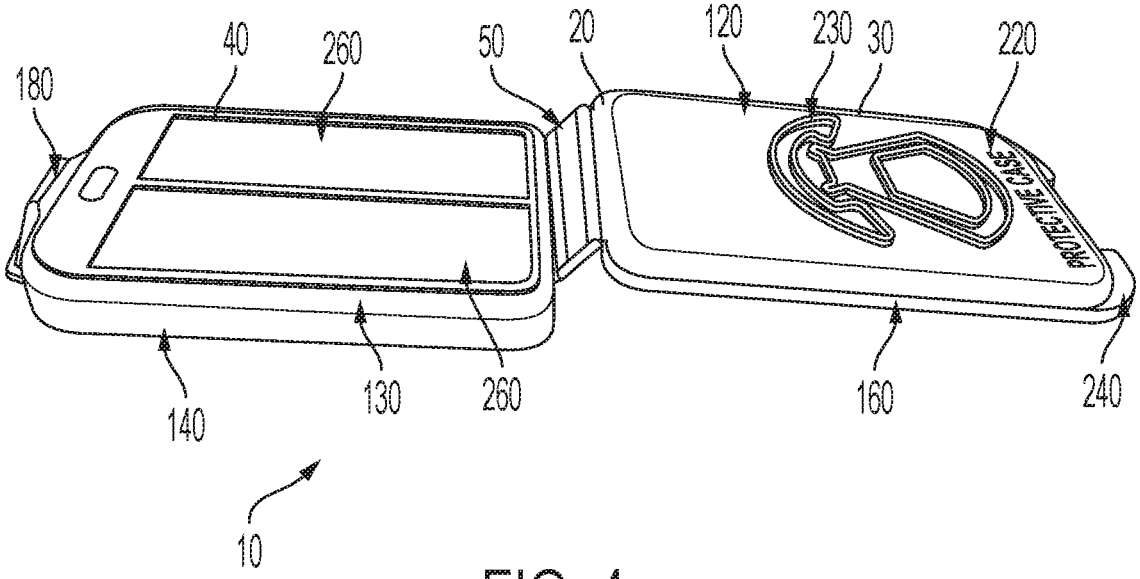
Figure 5:
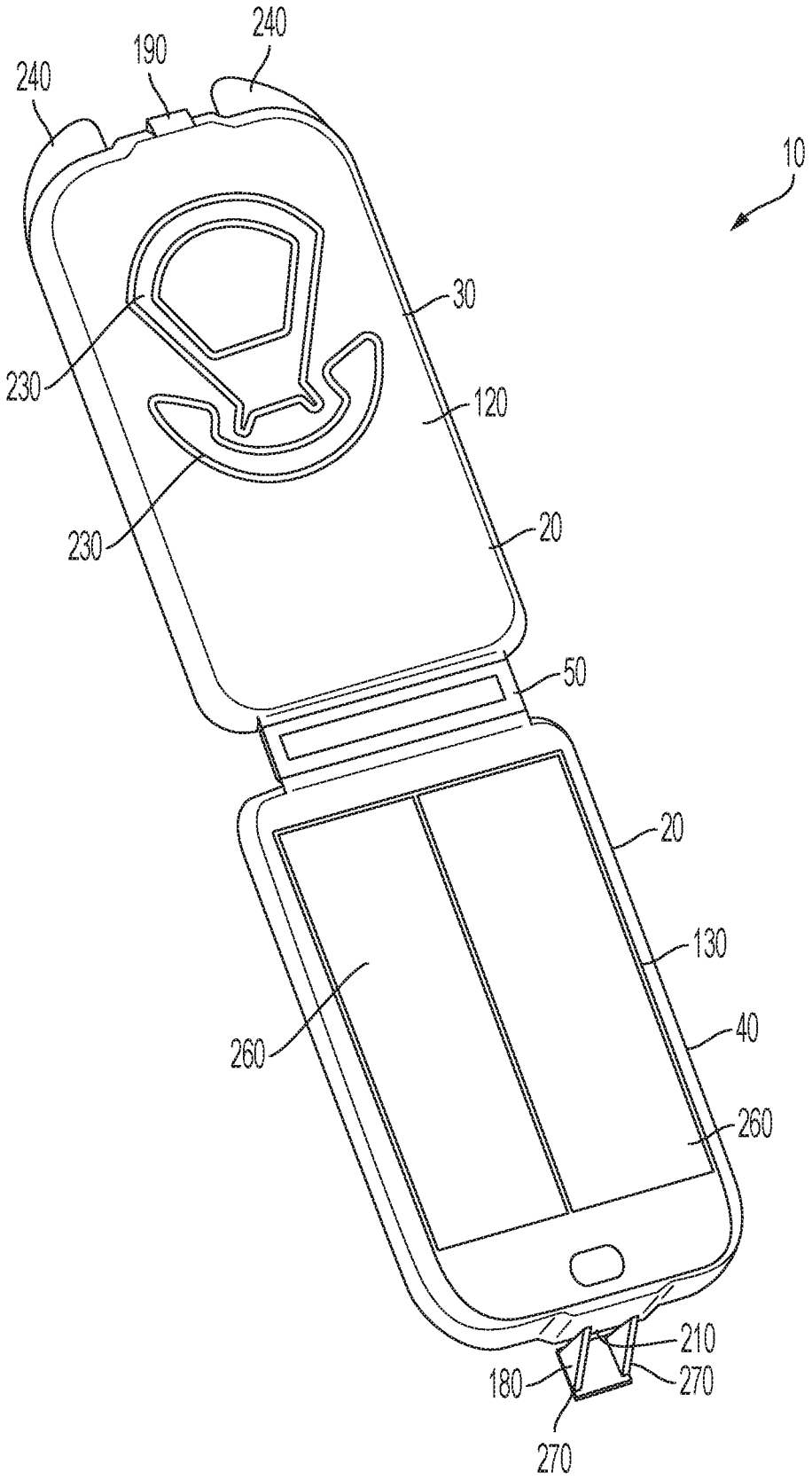

FIG. 4 is a perspective side view of a preferred embodiment of the protective case wherein the protective case is inverted and deployed in an open position; and FIG. 5 is a perspective view of a preferred embodiment of the protective case wherein the protective case is inverted, deployed in an open position, and the thumb press releasable latch is shown with a defined opening between the thumb press sidewalls.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE PREFERRED EMBODIMENT

Figure 1:
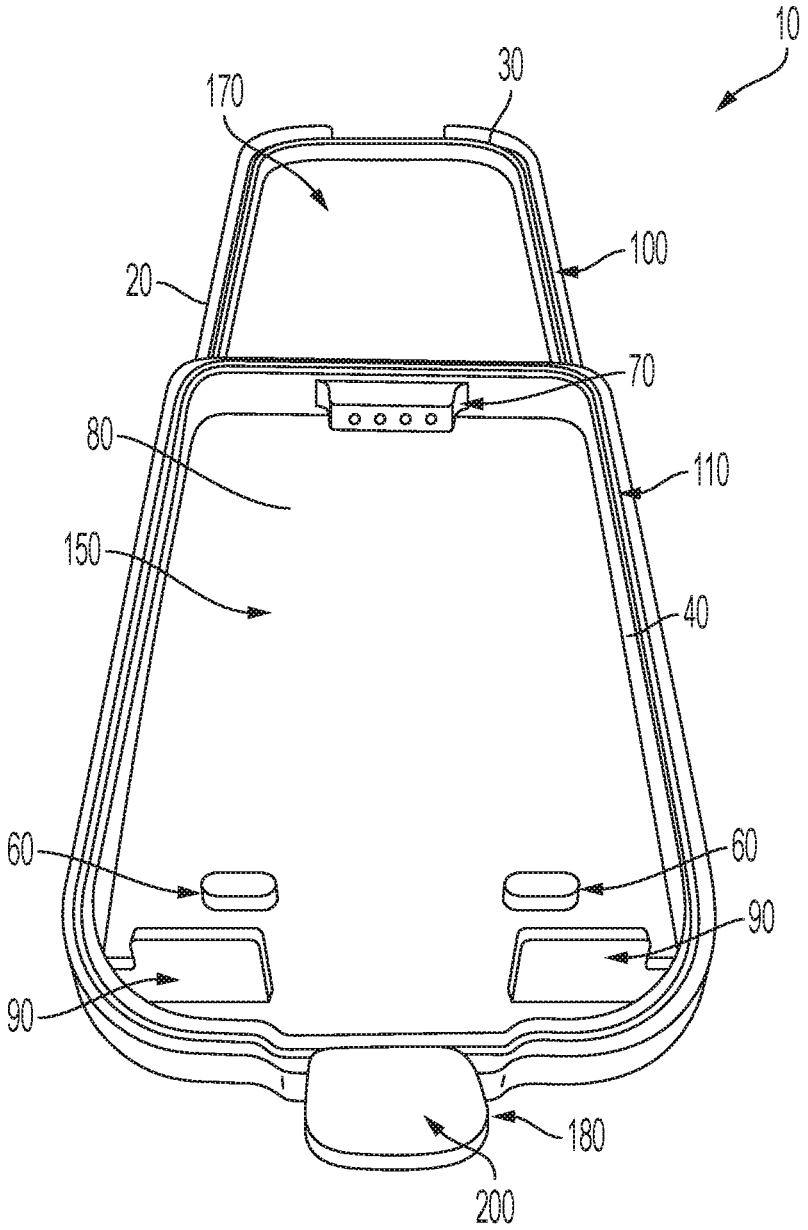
FIG. 1 is a perspective view of a preferred embodiment of the protective case while said case is in an open position with the case top and case base exposing the volume of the case shells.
Figure 3:
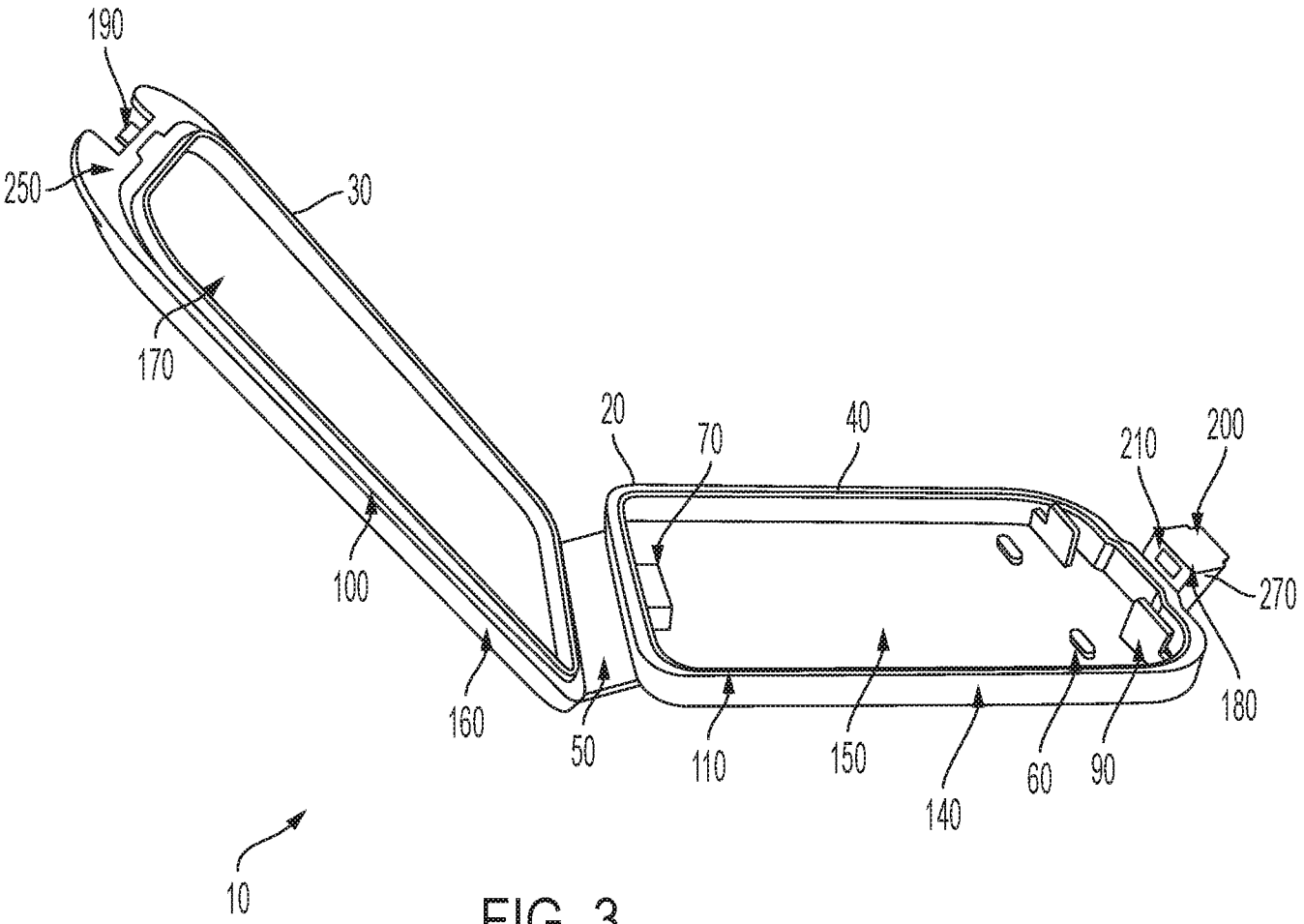
FIG. 3 is a perspective side view of a preferred embodiment of the protective case showing a case base hinged to a case top in an open position.

Referring now to the drawings in detail, FIG. 1 illustrates a preferred embodiment of a protective case 10 constructed in accordance with the present invention that is in an open configuration with both case shells 20, meaning the case top 30 and the case base 40 removably connected by a hinge 50, as shown in FIG. 3.

Figure 2:
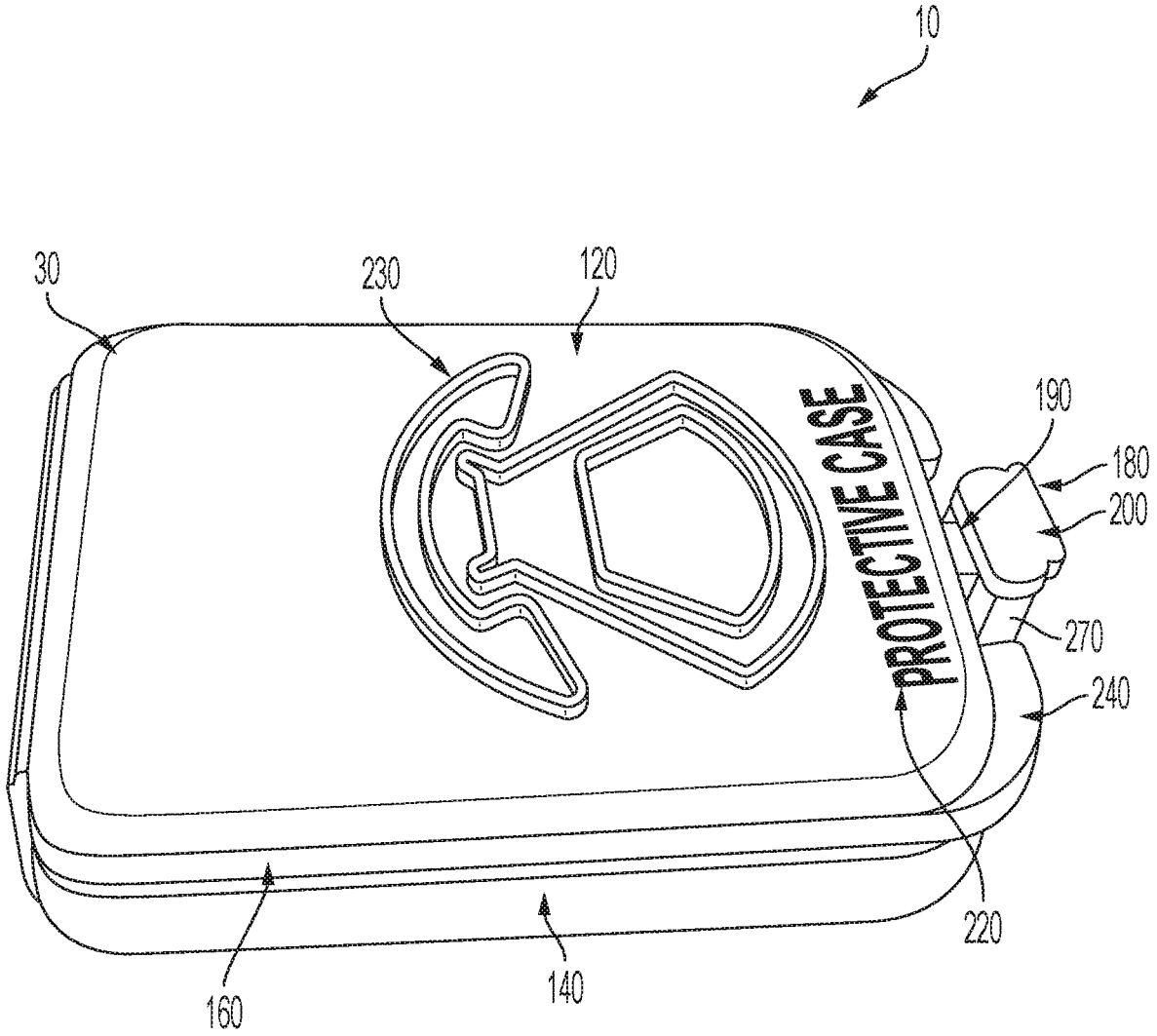
FIG. 2 is a perspective side view of a preferred embodiment of the protective case while said case is in a closed position.

In one aspect of the invention as contemplated herein, the interior of the case base 40 shows raised protrusions 60 and a keeper projection 70 contained within the volume of the shells 80, as well as two vertical posts 90. The raised protrusions 60, keeper projection 70, and the vertical posts 90 are all dimensioned in a direction away from the case base deck 150. The volume of the shells is a phrase used herein to describe the volume created between the case top 30 and case base 40 when they are in a closed hinged position, meaning the case top 30 is generally resting on the case base 40, as shown in FIG. 2. The case base 40 contains case base side walls 140 (shown in FIG. 2 and FIG. 3) which in conjunction with the case base deck 150, creates a depression within the case base 40 on the case base deck 150. Similarly, the case top 30 contains case top side walls 160, shown in FIG. 4, which in conjunction with the case top deck 170, creates an interior shell within the case top 30. This shell in the case top 30 combined with the similarly created shell in the case base 40, from the case base side walls 140, when the protective case 10 is in a closed position, as in FIG. 2, together creates this volume of the shells 80. Thus, the volume of the shells 80 is the created volume of the case base deck 150, case top deck 170, the case base side walls 140, and the case top side walls 160 when the protective case 10 is in the closed position, as illustrated in FIG. 2.

As previously alluded to, the case base side walls 140 and the case top side walls 160 provide a three-dimensional component to create the shells as referred to above. These sidewalls are preferably from the same material as the case top 30 and the case base 40, to provide stability. The height of the side walls is customizable, as the greater the height of each case shell 20 sidewall creates linearly more volume within the shells of said case shell(s) 20. It is contemplated that the protective case 10 may have alternative forms, or models, where the case shell 20 sidewalls are at such a height that items that a GPS transponder, a small first-aid kit, a flashlight, or other emergency kit items could be contained therein.

The keeper projection 70 is contemplated as a protrusion of material extending from the case base deck 150 that can act as a holder for small pieces of information, such as an index card, business card, or similar item. In a similar fashion the raised protrusions 60 act as does the keeper projection 70 but at an alternate location. The size and quantity of the keeper projection 70 and the raised protrusions 60 are able to be modified for different versions of the present invention, and as such different models of the protective case 10 as contemplated herein may feature differing size keeper projection 70, or possibly multiple keeper projections 70.

Similarly, the raised protrusions 60 size and quantity may be adjusted in the invention as contemplated herein. It is presently thought that these optional features, the raised protrusions 60 and the keeper projection 70, may act as a standing guide for cardboard, paper, or the like when the protective case 10 is in a longitudinal or latitudinal position, such that the information does not slide out of the protective case 10 when said protective case 10 is in an unhinged, open position.

The vertical posts 90 as shown in FIG. 1 are provided to act in a dual-function capacity. The vertical posts 90 can provide vertical support to larger items contained within the volume of the shells 80 while the protective case 10 is in a vertical position. However, the vertical posts 90 also provide resistance to a load in the z-dimension of the protective case 10, this being the dimension vertically through the center of the case base deck 150 and the case top deck 170. As such, the location, size, and quantity of the vertical posts 90 may differ depending on the desired circumstances, location, and area of use for a particular protective case 10.

An inner channel 100 may be provided on one of the case shells 20 to enhance the water-resistant nature of the protective case 10. The inner channel 100 is a tubular cavity groove located on or near the perimeter of a case shell 20. The inner channel 100 receives a ridge wall 110, which is located on the opposite case shell 20. The ridge wall 110 is dimensioned such as to contact and be secured in the inner channel 100 to provide a generally water-resistant seal when the protective case 10 is closed. Although not depicted in any of the illustrations, it is contemplated that a rubber seal may additionally be provided such as to provide additional water-resistant characteristics. This optional rubber seal may be attached to either the ridge wall 110 or the inner channel 100 without departing from the spirit of the present invention.

To seal the protective case 10 in the closed position, a latching mechanism is provided, such as a thumb press releasable latch 180. The thumb press releasable latch 180 is located on the perimeter of one of the case shells 20, and contacts with a shoulder tab 190 (as shown in FIG. 3) on the other case shell 20 when the protective case 10 is in a closed position. The shoulder tab 190 preferably is a compression latch which may be received within a cavity or an opening defined within the thumb press releasable latch 180, known herein as the thumb press opening 210 as shown in FIG. 2 and FIG. 3.

The thumb press releasable latch 180, when contacted with the shoulder tab 190, can be released from the connectivity with the shoulder tab 190 by applying downward pressure on the thumb press exterior face 200. When the thumb press exterior face 200 has said downward pressure applied, the thumb press releasable latch 180 shifts in a direction away from the protective case 10, which disengages the shoulder tab 190 from the thumb press opening 210.

Turning now to FIG. 2, the protective case 10 is shown in a closed position, where the shoulder tab 190 is connected to the thumb press releasable latch 180 by way of engagement within the thumb press opening 210. Also in this figure, the height of the case base side walls 140 and the case top side walls 160 is shown. Looking at the case top exterior 120, which is the exterior of the case top 30 or the inverse of the case top deck 170, there is shown a preferred but exemplary embodiment of the protective case 10 wherein concave depressions 220 are formed. These concave depressions 220 allow a user to apply a label, paint, or other device therein to increase rapid identification of the protective case 10 itself. The concave depressions 220 in the present example form words in the English language, but it may also be in the form of a pattern, logo, symbol, or words of any language.

An alternative to the previously mentioned concave depressions 220 which may be used to increase visibility is also shown here, by way of external projections 230 located on the case top exterior 120. The external projections 230 act in a similar fashion to the concave depressions 220, but instead of being a pit in the case top exterior 120 material, it is a protrusion of material therefrom. These external projections 230, or protrusions, can work together to form a symbol, as illustrated here, but may also form a pattern, logo, or words of any language. Echoing the statement of the concave depressions 220, the external projections are dimensioned such that a label, paint, or other device therein may increase rapid identification of the protective case 10.

In this embodiment, thumb lift wings 240 are shown, which are protrusions from the perimeter of the case top 30 similar to the thumb press releasable latch 180. The thumb lift wings 240 are used in conjunction with the releasing of the thumb press releasable latch 180. When the shoulder tab 190 is separated from the thumb press opening 210, a user can lift the case top 30 from its position by applying upward pressure on the bottom of the thumb lift wings 240, known as the thumb lift bottom 250, and shown in FIG. 3.

FIG. 3 illustrates a side view of a preferred embodiment of the protective case 10 with the hinge 50 shown, and the protective case 10 deployed in an open position. In this illustrated embodiment, the case base 40 is a separate entity, though as described above it may be formed within a car dashboard cover or molded, formed, or otherwise constructed in any other structure for permanence.

As shown here, the case top 30 is displayed in a side view, with the thumb lift bottom 250 depicted. The thumb lift bottom 250 is where a user would apply pressure to assist in the disengagement of the shoulder tab 190 from the thumb press opening 210 and thus the thumb press releasable latch 180.

In FIG. 4, a preferred embodiment of the protective case 10 is shown, with the case shells 20 deployed in an inverted position. The case top 30 is shown with case top concave depressions 220 and external projections 230. Additionally, the case base 40 contains case base depressions 260 which act in a similar fashion to the case top concave depressions 220 on the case top 30. A user may use a label, paint, or other device to increase rapid identification and spatial location of the protective case 10 in an emergency situation. These case base depressions 260 may take the form of a symbol, a logo, words of any language, or a pattern. As shown here, the protective case 10 is generally rectangular with a pair of elongate and generally straight edges that extend substantially the length of the protective case 10. Here, the protective case 10 material is made from a heat-resistant material such as a polymer. The material may be one of high-density polyethylene, a polypropylene, a polyphenylene, ABS polymer, a thermoset plastic, polyvinyl chloride, and a polyamide. It is thought that the entirety of the protective case 10 is made from the same material, though it is contemplated that one could create an embodiment of the protective case 10 from multiple different materials.

Looking now at FIG. 5, a preferred embodiment of the protective case 10 is shown with the hinge 50 or spring in an open position, wherein the case top 30 and the case base 40 are not presently mated or coupled. Also, the thumb press opening 210 is shown as an opening defined between the thumb press side walls 270 of the thumb press releasable latch 180. It is within this opening that the shoulder tab 190 is adapted to mate so as to close the shells 20, being the case top 30 and the case base 40, of the protective case 10. In this embodiment, the case top exterior 120 has multiple external projections 230, so as to receive an adhesive label, such as reflective one to enhance visibility.

Understandably, the present protective case 10 has been described above in terms of one or more preferred embodiments or models. It is recognized that various alternatives and modifications may be made to these embodiments and methods that are within the scope of the present invention. Various alternatives are contemplated as being within the scope of the present invention. It is also to be understood that, although the foregoing description and drawings describe and illustrate in detail one or more preferred embodiments of the protective case 10, to those skilled in the art of which this invention relates, the present disclosure will suggest many modifications, models, and constructions, as well as widely differing embodiments and applications without thereby departing from the spirit and scope of the invention.

What is claimed is:

1. A protective case with a first shell mating case and a second shell mating case defining an interior volume when the first shell case and second shell case are mated, said protective case comprising:

a first shell case base comprising a plurality of side walls, a front wall, a back wall, and a case base deck having an interior face and an exterior face;

a plurality of raised protrusions extending vertically away from the case base deck;

a plurality of vertical posts extending vertically away from the case base deck;

a thumb press releasable latch comprising a plurality of vertical side walls and defining an opening between the side walls, said thumb press releasable latch attached to the front wall of the case base and extending away from said case base;

a second shell case top comprising a plurality of side walls, a front wall, a back wall, and a case top deck having an interior face and an exterior face;

wherein the exterior face of the second shell case top deck additionally comprises a plurality of external projections;

wherein the second shell case top deck external projections form a symbol;

a plurality of thumb wings attached to the front wall of the case top and extending away from said case top;

a shoulder tab attached to the front wall of the case top and extending away from said case top;

wherein the shoulder tab is adapted to be received in the opening defined between the vertical side walls of the thumb press releasable latch;

a hinge having a first distal end and a second distal end;

wherein the first distal end of the hinge is connected to the case base; and wherein the second distal end of the hinge is connected to the case top.

2. The protective case of claim 1, wherein the external projections of the case top deck additionally form a word.

3. The protective case of claim 2, wherein reflective adhesive labels are positioned within the plurality of external projections of the case top deck exterior face.

4. The protective case of claim 3, wherein the exterior face of the case base deck additionally comprises a plurality of depressions.

5. The protective case of claim 4, wherein one of a hook and loop fastener, adhesive tape, and a magnet are positioned within the depressions formed on the exterior face of the case base deck.

6. The protective case of claim 5, wherein the plurality of vertical side walls of the thumb press releasable latch are triangularly shaped.

7. The protective case of claim 6, wherein a keeper projection is attached to the interior of the back wall of the case base.

8. The protective case of claim 7, wherein a ridge wall is formed around the circumference of the first shell case base plurality of side walls, front wall, and back wall.

9. The protective case of claim 8, wherein a gasket is provided on the ridge wall around the circumference of the first shell case base plurality of side walls, front wall, and back wall.

10. The protective case of claim 7, wherein an inner channel is formed around the circumference of the side walls, front wall, and back wall of the second shell case top.

11. The protective case of claim 10, wherein a gasket is provided within the inner channel formed around the circumference of the side walls, front wall, and back wall of the second shell case top.

12. The protective case of claim 1, wherein the vertical posts are of a greater height than the raised protrusions.

13. The protective case of claim 12, wherein the vertical posts extend to a height beyond that of the first shell case base side walls.

14. The protective case of claim 13, wherein the exterior face of the case base deck additionally comprises a plurality of depressions.

15. The protective case of claim 14, wherein a hook and loop fastener is positioned within the plurality of depressions of the case base deck.

16. The protective case of claim 14, wherein a magnet is positioned within the plurality of depressions of the case base deck.

17. The protective case of claim 14, wherein adhesive tape is positioned within the plurality of depressions of the case base deck.

18. The protective case of claim 14, wherein the plurality of vertical side walls of the thumb press releasable latch are triangularly shaped.

19. The protective case of claim 18, wherein a keeper projection is attached to the interior of the back wall of the case base.

20. The protective case of claim 19, wherein the external projections of the case top deck additionally form a word.

* * * * *